US009593605B2

(12) United States Patent
Ulrey et al.

(10) Patent No.: US 9,593,605 B2
(45) Date of Patent: Mar. 14, 2017

(54) CRANKCASE VENTILATION VIA CRANKCASE PULSATION

(71) Applicants: Joseph Norman Ulrey, Dearborn, MI (US); Ross Dykstra Pursifull, Dearborn, MI (US)

(72) Inventors: Joseph Norman Ulrey, Dearborn, MI (US); Ross Dykstra Pursifull, Dearborn, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 115 days.

(21) Appl. No.: 13/621,711

(22) Filed: Sep. 17, 2012

(65) Prior Publication Data

US 2014/0076294 A1 Mar. 20, 2014

(51) Int. Cl.
*F02B 25/06* (2006.01)
*F01M 13/02* (2006.01)

(52) U.S. Cl.
CPC ..... *F01M 13/022* (2013.01); *F01M 13/028* (2013.01)

(58) Field of Classification Search
CPC ..... F02M 25/06; F02M 35/10222; F02D 2200/0406; F01M 13/04; F01M 13/00; F01M 13/0011; F01M 13/02; F01M 13/022; F01M 13/023; F01M 13/028; F01M 2013/0044; F01M 2013/0083; F01M 2013/0094; F01M 2013/027
USPC ..... 123/41.86, 572–574
See application file for complete search history.

(56) References Cited

U.S. PATENT DOCUMENTS

| | | | | |
|---|---|---|---|---|
| 3,589,347 | A | 6/1971 | Sawada | |
| 3,742,923 | A * | 7/1973 | Oblander et al. | 123/572 |
| 4,136,650 | A * | 1/1979 | Manookian, Jr. | 123/573 |
| 4,901,703 | A * | 2/1990 | Humphries | 123/572 |
| 4,962,745 | A * | 10/1990 | Ohno et al. | 123/533 |
| 5,080,082 | A | 1/1992 | Mueller et al. | |
| 5,803,025 | A * | 9/1998 | Feucht | 123/41.86 |
| 5,881,686 | A | 3/1999 | Schmidt | |
| 5,967,178 | A | 10/1999 | Shrode | |
| 6,196,207 | B1 * | 3/2001 | Megas | 123/572 |
| 6,460,525 | B1 | 10/2002 | Shureb | |
| 6,606,982 | B1 * | 8/2003 | Stockhausen et al. | 123/572 |
| 6,644,290 | B2 | 11/2003 | Yoneyama et al. | |
| 6,920,869 | B2 * | 7/2005 | Murata et al. | 123/572 |
| 7,080,636 | B2 * | 7/2006 | Knaus et al. | 123/572 |
| 7,523,748 | B2 * | 4/2009 | Hirano et al. | 123/572 |
| 7,712,456 | B2 * | 5/2010 | Hirano | 123/572 |
| 7,775,198 | B2 * | 8/2010 | Shieh | 123/574 |
| 8,109,259 | B2 | 2/2012 | Ulrey et al. | |
| 8,132,560 | B2 | 3/2012 | Ulrey et al. | |

(Continued)

*Primary Examiner* — Marguerite McMahon
*Assistant Examiner* — Tea Holbrook
(74) *Attorney, Agent, or Firm* — Julia Voutyras; John D. Russell; B. Anna McCoy

(57) ABSTRACT

Systems and methods for ventilating crankcase gases in a crankcase ventilation system via crankcase pressure pulsations are disclosed. In one example approach, a method comprises driving flow of crankcase ventilation gases through a crankcase of the engine from a fresh air inlet of the crankcase to an outlet of the crankcase via crankcase pressure pulsations while restricting backflow of crankcase ventilation gases from the outlet to the inlet, where the inlet and outlet are coupled upstream of an intake throttle of the engine.

19 Claims, 3 Drawing Sheets

(56) References Cited

U.S. PATENT DOCUMENTS

| | | | | |
|---|---|---|---|---|
| 8,181,635 | B2 | 5/2012 | Ogawa et al. | |
| 8,393,315 | B2 * | 3/2013 | Ruppel et al. | 123/574 |
| 8,555,827 | B2 * | 10/2013 | Schleiden | 123/41.86 |
| 2001/0047801 | A1 * | 12/2001 | Baeuerle et al. | 123/574 |
| 2001/0054418 | A1 * | 12/2001 | Burgess | 123/572 |
| 2002/0046743 | A1 * | 4/2002 | Moren | 123/572 |
| 2003/0116147 | A1 * | 6/2003 | Rengmyr | 123/572 |
| 2004/0112346 | A1 * | 6/2004 | Ahlborn et al. | 123/572 |
| 2004/0261776 | A1 * | 12/2004 | Knaus et al. | 123/572 |
| 2005/0005921 | A1 * | 1/2005 | Ikeda et al. | 123/572 |
| 2006/0090737 | A1 * | 5/2006 | Pietschner | 123/572 |
| 2006/0102159 | A1 * | 5/2006 | Hommes | 123/572 |
| 2008/0110443 | A1 * | 5/2008 | Hirano | 123/572 |
| 2008/0223347 | A1 * | 9/2008 | Hommes et al. | 123/572 |
| 2009/0223498 | A1 * | 9/2009 | Shieh | 123/574 |
| 2010/0089341 | A1 * | 4/2010 | Richardson et al. | 123/3 |
| 2010/0126479 | A1 * | 5/2010 | Shieh et al. | 123/573 |
| 2010/0313830 | A1 * | 12/2010 | Ruppel et al. | 123/41.86 |
| 2011/0073083 | A1 | 3/2011 | Shiraishi et al. | |
| 2011/0197864 | A1 * | 8/2011 | Karcher | 123/574 |
| 2011/0277733 | A1 * | 11/2011 | Spix et al. | 123/574 |

* cited by examiner

CRANKCASE VENTILATION VIA CRANKCASE PULSATION

BACKGROUND/SUMMARY

Engines may include crankcase ventilation systems to vent gases out of the crankcase and into an engine intake manifold to provide continual evacuation of gases from inside the crankcase in order to reduce degradation of various engine components in the crankcase.

In some approaches, positive crankcase ventilation (PCV) systems may use steady state pressure differences to inject fresh air into the crankcase or pull fresh air mixed with blow-by gases out of the crankcase. For example, in some approaches a breather or vent tube may couple the crankcase to a fresh air intake upstream of the throttle and another PCV conduit may couple the crankcase to the intake manifold downstream of the throttle so that pressure differences between the fresh air intake and the intake manifold may be used to drive flow of PCV gases through the crankcase.

However, the inventors herein have recognized that in such approaches the direction of flow through the crankcase ventilation system may change depending on engine operating conditions. Such bidirectional flows through crankcase ventilation systems may increase costs associated controlling and monitoring the crankcase ventilation system and reduce effectiveness of gas evacuation from the crankcase thus potentially increasing emissions and crankcase degradation.

For example, in such approaches ventilation gases may flow in a direction through the crankcase from the fresh air intake to the intake manifold during a first condition and ventilation gases may flow in a direction from the intake manifold to the fresh air inlet during other conditions. In such approaches, since crankcase ventilation gases have a bidirectional flow, multiple oil separators may be employed which increases costs associated with the inclusion of oil separators and associated sensors or valves. For example, in such approaches an oil separator may be coupled to the breather tube and another oil separator may be coupled to the PCV conduit to substantially prevent oil from entering the engine intake.

Further, since in such approaches gas flow through the ventilation system depends on steady state pressure differences in the intake manifold, the gas flow through the crankcase ventilation system may be reduced during certain conditions which may be disadvantageous for boosted engines or engines which have high exhaust humidity, e.g., engines fueled with ethanol or methanol, which require increased crankcase ventilation. Further, in such approaches steady flow rates may be disrupted and fall below a threshold needed to keep oil separator efficiency high. For example, low crankcase pressure may be favorable for turbochargers with hydrodynamic bearings, e.g. journal bearings. Further still, since in such approaches the crankcase gasses combined with ventilation air bypass the throttle, the ability of the throttle to control to low air flow rates may be degraded.

Thus, in one approach, to at least partially address these issues, a method for an engine with a crankcase ventilation system is provided. The method comprises driving flow of crankcase ventilation gases through a crankcase of the engine from a fresh air inlet of the crankcase to an outlet of the crankcase via crankcase pressure pulsations while restricting backflow of crankcase ventilation gases from the outlet to the inlet, where the inlet and outlet are coupled upstream of an intake throttle of the engine.

In this way, crankcase pulsation energy may be used to drive crankcase ventilation flow and a check valve at the crankcase's fresh air inlet or mixed air outlet may rectify the flow pulsations to create a unidirectional flow. Such a unidirectional system has the potential advantage of requiring only one oil separator instead of two, resulting in a reduction in costs. Further, such an approach increases ventilation gas flow and control while reducing costs associated with sensors and valves for monitoring, oil separation and control. For example, low engine air flow rate control to the throttle may be increased since it is no longer bypassed to power PCV flow and flow rates in excess of a threshold amount may be used to provide a constant flow rate to an oil separator.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
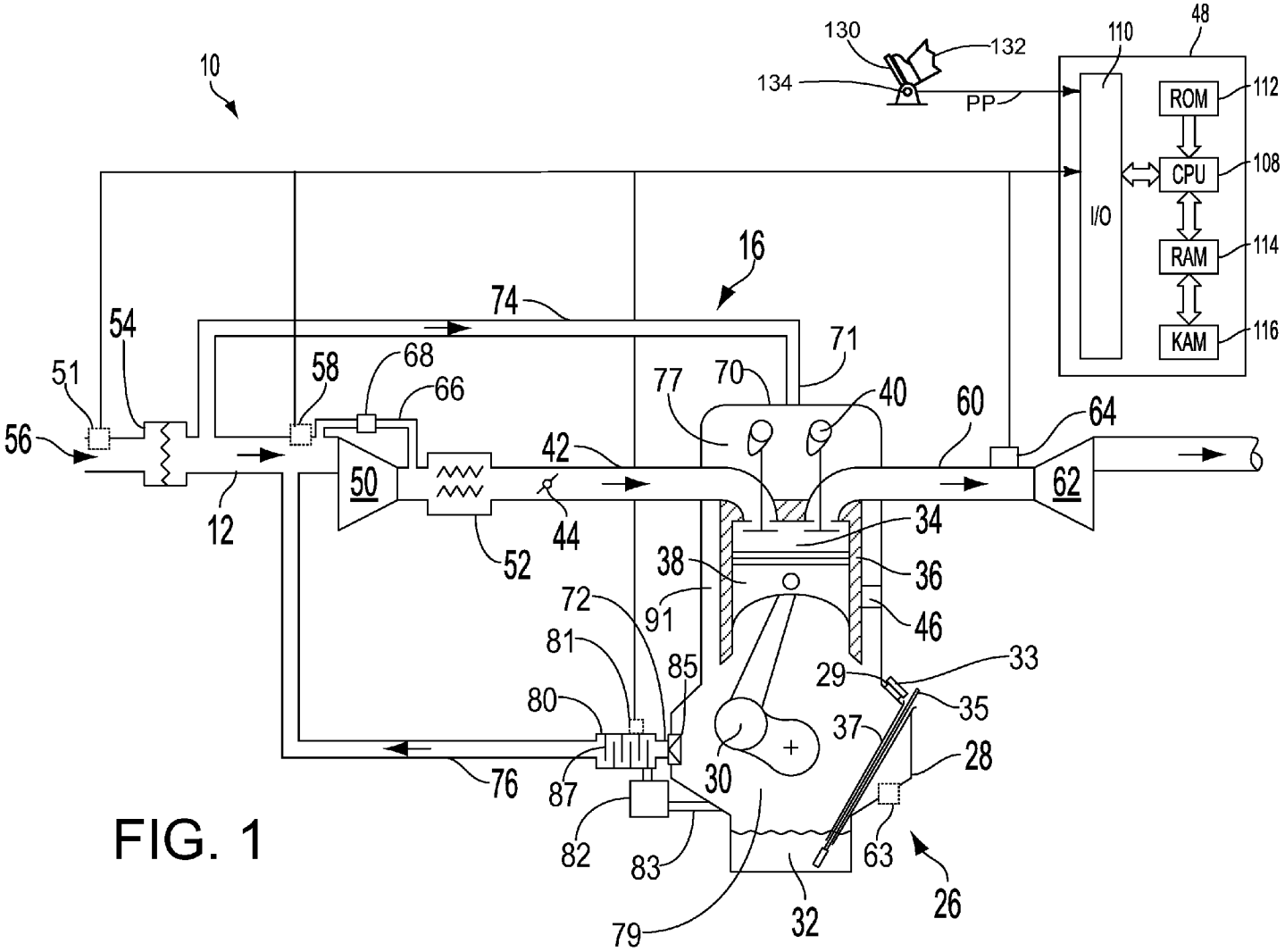
FIG. 1 shows a schematic view of an engine with a crankcase ventilation system in accordance with the disclosure.
Figure 2:
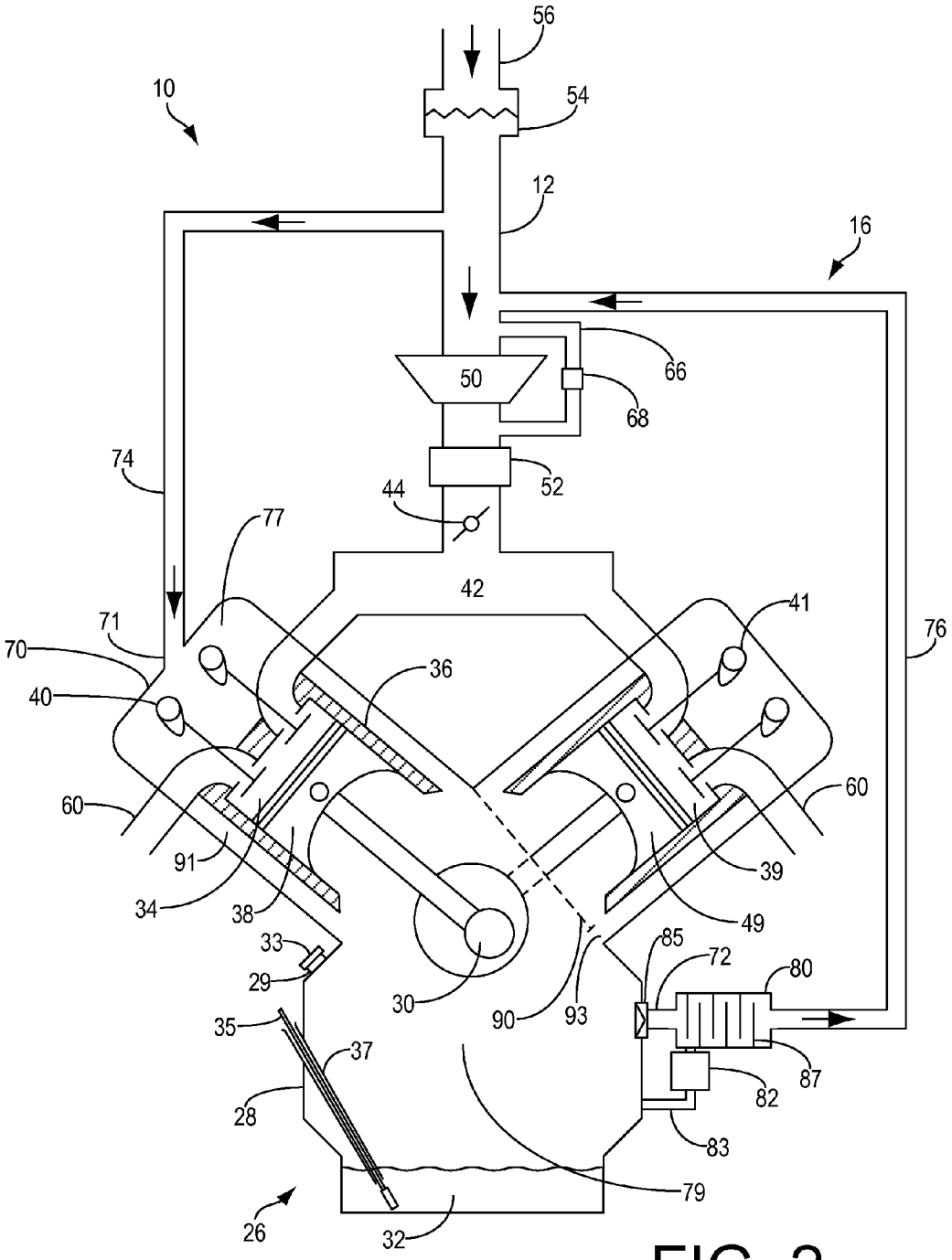
FIG. 2 shows another schematic view of an engine with a crankcase ventilation system in accordance with the disclosure.
Figure 3:
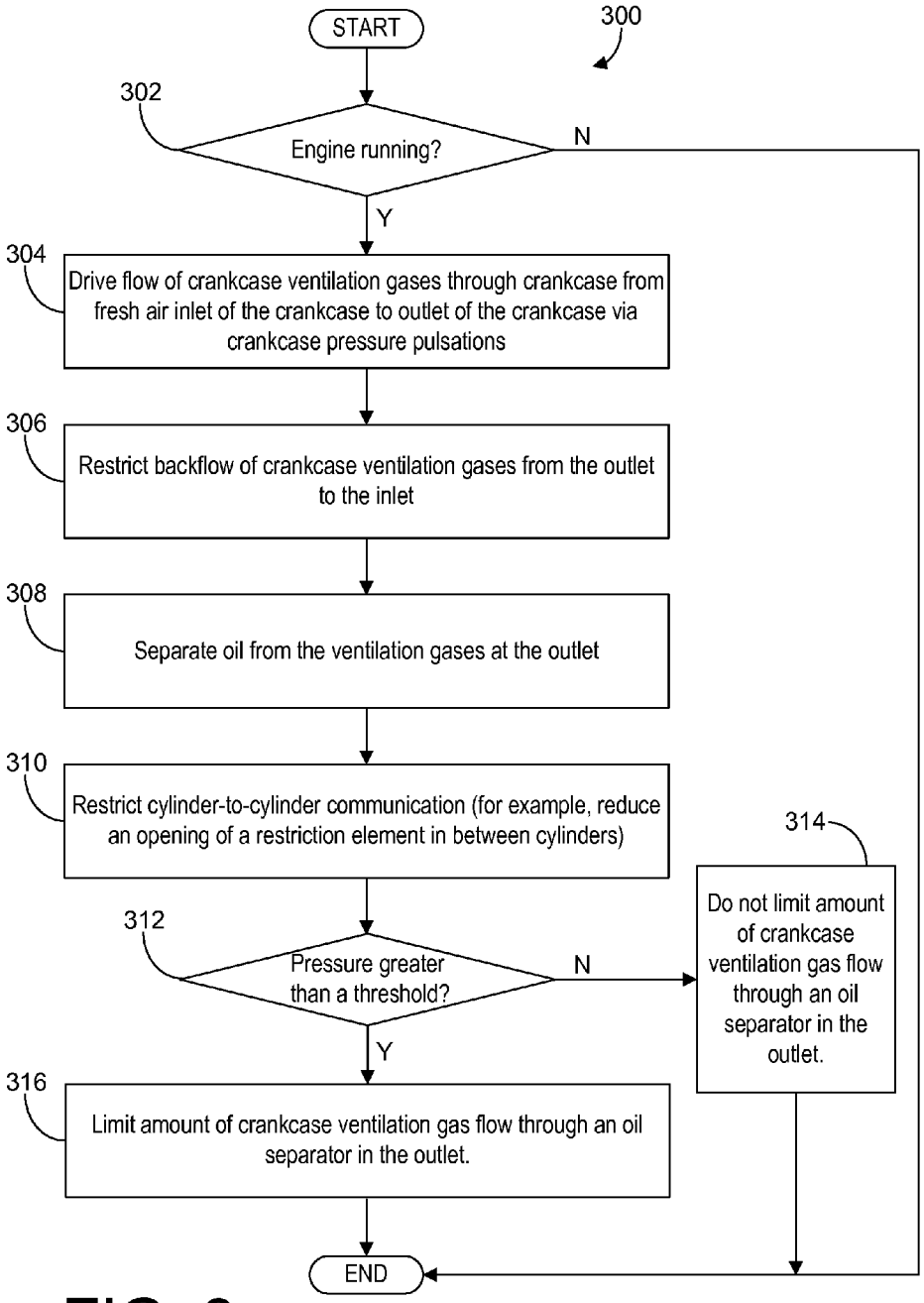
FIG. 3 shows an example method for an engine with a crankcase ventilation system in accordance with the disclosure.

The following description relates to systems and methods for ventilating crankcase gases in a crankcase ventilation system via crankcase pressure pulsations in an engine, such as the engine shown in FIGS. 1 and 2. As shown in FIG. 3, crankcase ventilation gases may be driven through the crankcase, or other variable volume device, of the engine from a fresh air inlet of the crankcase to an outlet of the crankcase via crankcase pressure pulsations while restricting backflow of crankcase ventilation gases from the outlet to the inlet, where the inlet and outlet are coupled upstream of an intake throttle of the engine.

Referring now to FIG. 1, it shows an example system configuration of a multi-cylinder engine, generally depicted at 10, which may be included in a propulsion system of an automobile. Engine 10 may be controlled at least partially by a control system including controller 48 and by input from a vehicle operator 132 via an input device 130. In this example, input device 130 includes an accelerator pedal and a pedal position sensor 134 for generating a proportional pedal position signal PP.

Engine 10 may include a lower portion of the engine block, indicated generally at 26, which may include a crankcase 28 encasing a crankshaft 30 with oil well 32 positioned below the crankshaft. An oil fill port 29 may be disposed in crankcase 28 so that oil may be supplied to oil well 32. Oil fill port 29 may include an oil cap 33 to seal oil port 29 when the engine is in operation. A dip stick tube 37 may also be disposed in crankcase 28 and may include a dipstick 35 for measuring a level of oil in oil well 32. In addition, crankcase 28 may include a plurality of other orifices for servicing components in crankcase 28. These orifices in crankcase 28 may be maintained closed during engine operation so that a crankcase ventilation system (described below) may operate during engine operation.

The upper portion of engine block 26 may include a combustion chamber (i.e., cylinder) 34. The combustion chamber 34 may include combustion chamber walls 36 with piston 38 positioned therein. Piston 38 may be coupled to crankshaft 30 so that reciprocating motion of the piston is translated into rotational motion of the crankshaft. Piston movement in the crankcase may generate pressure pulsations in the crankcase which may be used to drive ventilation gases through a crankcase ventilation system as described in more detail below. In particular, changes in position of a cylinder piston lead to changes in volume of the crankcase resulting in period increases and decreases in pressure (pressure pulsations) within the crankcase.

Combustion chamber 34 may receive fuel from fuel injectors 40 and intake air from intake manifold 42 which is positioned downstream of throttle 44. The engine block 26 may also include an engine coolant temperature (ECT) sensor 46 input into an engine controller 48.

A throttle 44 may be disposed in the engine intake to control the airflow entering intake manifold 42 and may be preceded upstream by compressor 50 followed by charge air cooler 52, for example. An air filter 54 may be positioned upstream compressor 50 and may filter fresh air entering intake passage 56. In some examples, a compressor bypass conduit 66 may be coupled upstream and downstream of compressor 50. Compressor bypass conduit 66 may include a compressor bypass valve 68 to control an amount of air entering compressor 50. Compressor bypass conduit may be coupled to intake 42 upstream of charge air cooler 52.

Exhaust combustion gases exit the combustion chamber 34 via exhaust passage 60 located upstream of turbine 62. An exhaust gas sensor 64 may be disposed along exhaust passage 60 upstream of turbine 62. Turbine 62 may be equipped with a wastegate bypassing it. Sensor 64 may be a suitable sensor for providing an indication of exhaust gas air/fuel ratio such as a linear oxygen sensor or UEGO (universal or wide-range exhaust gas oxygen), a two-state oxygen sensor or EGO, a HEGO (heated EGO), a NOx, HC, or CO sensor. Exhaust gas sensor 64 may be connected with controller 48.

In the example of FIG. 1, a positive crankcase ventilation system (PCV) 16 is coupled to the engine intake so that gases in the crankcase may be vented in a controlled manner from the crankcase.

Crankcase ventilation system 16 includes a crankcase fresh air inlet 71 coupled to an air intake 12 of the engine upstream of throttle 44. Fresh air inlet 71 may be coupled to fresh air intake 12 via a breather or vent tube 74. The crankcase ventilation system 16 draws air into crankcase 28 via the breather or vent tube 74. In some examples, breather tube 74 may be coupled to fresh air intake 12 upstream of compressor 50. In some examples, breather tube may be coupled to air cleaner 54. In other examples, breather tube may be coupled to intake 12 downstream of air cleaner 54.

Crankcase ventilation system 16 also includes a crankcase outlet 72 coupled to the air intake 12 upstream of the throttle 44. Outlet 72 may be coupled to fresh air intake 12 of the engine upstream of throttle 44. In some examples, outlet 72 may be coupled to fresh air intake 12 upstream of compressor 50. The crankcase ventilation system vents air out of the crankcase and into intake manifold 42 via conduit 76.

By coupling the outlet 72 and inlet 71 to intake 12 upstream of throttle 44, pumping action of the crankcase may be used to drive a unidirectional crankcase ventilation flow. This is in contrast to approaches which employ steady state pressure to drive crankcase ventilation flow by coupling outlet 72 to an engine intake at a position downstream of the throttle.

In some examples, conduit 76 may be coupled to fresh air intake 12 downstream of a coupling of breather tube 74 with fresh air intake 12. However, in other examples, conduit 76 may be coupled to fresh air intake 12 upstream of a coupling of breather tube 74 with fresh air intake 12 or conduit 76 may be coupled to fresh air intake 12 at substantially the same position along fresh air intake 12 as a coupling of breather tube 74 with fresh air intake 12. Since pressure pulsations due to piston movement in the crankcase are used to drive air flow through the ventilation system rather than pressure differences in the intake, the relative positions of the couplings of conduit 76 and breather tube 74 in fresh air intake 12 may be varied.

In some examples, inlet 71 may be coupled to a pulsation-restricted zone of the crankcase and outlet 72 may be coupled to a pulsation zone of the crankcase in order to increase pressure differences between inlet 71 and outlet 72 to drive flow of ventilation gases through crankcase ventilation system 16. A pulsation-restricted zone of the crankcase may be a region of the crankcase which is at least partially isolated from changes in volume caused by piston and crankshaft movement whereas a pulsation zone of the crankcase may be a region of the crankcase which is exposed to changes in volume caused by piston and crankshaft movement. In particular, amplitudes of pressure pulsations at a pulsation-restricted zone may be less than amplitudes of pressure pulsations at a pulsation zone.

For example, the crankcase fresh air inlet 71 may be coupled to crankcase 28 at a region 77 of the crankcase at least partially isolated from crank 30 of the crankcase and crankcase outlet 72 may coupled to crankcase 28 at a region 79 of the crankcase adjacent to crank 30. Region 77 may be a region of the crankcase between cylinder valve cover 70 and combustion chamber walls 36 whereas region 79 may be a region of the crankcase between oil well 32 and crank 30 or beneath piston 38 in the crankcase. Pulsation-restriction zone region 77 may be fluidically coupled to pulsation zone region 79 via a passage, e.g., passage 91 so that blow-by gases may be ventilated by the ventilation system. Combustion chamber walls 36 partially isolate region 77 from the high pressure pulsations at region 79 so a pressure difference between region 77 and region 79 drive flow of ventilation gases through the ventilation system.

For example, inlet 71 may be coupled to cylinder valve cover 70 or some other region along a head of a cylinder which may be at least partially isolated from pressure pulsations in the crankcase. Outlet 72 may in turn be coupled to a region of the crankcase which is exposed to pressure pulsations which are larger in magnitude than the pressure pulsations at inlet 71. For example, outlet 72 may be coupled to the crankcase proximal to dipstick 35 or proximal to crank 30.

Crankcase ventilation system 16 further includes a unidirectional check valve 85 disposed in the inlet 71 or outlet 72. Though FIG. 1 shows unidirectional valve 85 disposed in the outlet 72, in some examples unidirectional valve may instead be disposed in the inlet 71. Further, in other examples, unidirectional valve 85 may be disposed in breather tube 74 or in conduit 76. In still other examples, a unidirectional check valve may be disposed in both the inlet 71 and/or the outlet 72. The check valve may be constructed in a number of ways including a reed valve or a duckbill valve, for example. By including a check valve at the inlet and/or outlet a volumetric efficiency of using the crankcase as a pump may be significantly increased.

The unidirectional check valve 85 directs flow of crankcase ventilation gases driven by crankcase pressure pulsations through the crankcase in a direction from the inlet 71 to the outlet 72 and restricts backflow of crankcase ventilation gases from the outlet 72 to the inlet 71. By placing a check valve at the crankcase's fresh air inlet or mixed air outlet the flow pulsations may be rectified to create a unidirectional flow through the crankcase ventilation system. This unidirectional system has the advantage of requiring only one oil separator 80 instead of two or more, resulting in a reduction of costs. Further, this system restores low engine air flow rate control to the throttle since it is no longer bypassed.

Thus, crankcase ventilation system 16 includes only a single oil separator 80 coupled to the outlet 72 and no oil separator coupled to the inlet 71. For example, oil separator may be disposed in conduit 76. Oil separator 80 filters oil from vapors exiting crankcase 28 before they re-enter the intake system 12. Oil separator 80 includes a plurality of baffles 87 or other surfaces which permit flow of ventilation gases therethrough while separating oil from the ventilation gases exiting crankcase 28.

An oil drain line 83 may be coupled to the oil separator 80 and the crankcase 28 to return oil filtered in oil separator 80 to the crankcase or oil well 32. In some examples, a pressure regulator 82 may be coupled to the oil separator. For example pressure regulator 82 may be an oil liquid column pressure regulator coupled to oil separator 80 and oil drain line 83. In some examples, pressure regulator may limit an amount of pressure and/or flow through the oil separator during certain conditions.

For example, if a pressure or flow of ventilation gases through oil separator 80, e.g., as measured by a pressure sensor 81 in oil separator 80, is above a threshold value then pressure regulator 82 may reduce the amount of pressure or flow of ventilation gases flowing through oil separator 80. For example, during high engine speeds pumping motion from a cylinder may lead to an increase in magnitude of pressure pulsations in the crankshaft to drive flow of ventilation gases through the ventilation system. Such an increase in magnitude of pressure pulsations may overwhelm the oil separator reducing the capacity of oil separator 80 to remove oil from ventilation gases returning to intake 12. The pressure regulator 82 may assist in maintaining a substantially constant pressure or flow through the oil separator so that operation of the oil separator does not degrade. For example, if the pressure regulator is an oil liquid column pressure regulator, such as a monometer of oil coupled to oil drain line 83, when the pressure increases the head pressure also increases until the oil is pushed out into the crankcase along with the excess blow-by gases.

Controller 48 is shown in FIG. 1 as a microcomputer, including microprocessor unit 108, input/output ports 110, an electronic storage medium for executable programs and calibration values shown as read only memory chip 112 in this particular example, random access memory 114, keep alive memory 116, and a data bus. Controller 48 may receive various signals from various sensors coupled to engine 10, engine coolant temperature (ECT) from temperature sensor 46; exhaust gas air/fuel ratio from exhaust gas sensor 64; and other PCV sensors such as a pressure sensor 63 in the crankcase, pressure sensor 81 in the oil separator, barometric pressure (BP) sensor 51, compressor inlet pressure (CIP) sensor 58, etc. Storage medium read-only memory 112 can be programmed with computer readable data representing instructions executable by processor 108 for performing the methods described below, as well as other variants that are anticipated but not specifically listed.

In some examples, crankcase cylinder-to-cylinder communication may be at least partially restricted in the crankcase in order to increase a magnitude of pressure pulsations generated in the crankcase to increase an amount of flow of ventilation gases through the crankcase ventilation system. For example, FIG. 2 shows a schematic view of an engine with a crankcase ventilation system and a restricted crankcase cylinder-to-cylinder communication. The numbered elements shown in FIG. 2 correspond to like numbered elements shown in FIG. 1 described above.

FIG. 2 shows two cylinders of an engine, a first cylinder 34 with piston 38 and fuel injectors 40, and a second cylinder 39 with piston 49 and fuel injectors 41. In this example the first cylinder is at least partially restricted from the second cylinder 39 and/or other cylinders in the engine so that first cylinder 34 acts as a pump to drive ventilation gases through crankcase ventilation system 16. In particular, piston 38 may be coupled to crankshaft 30 so that reciprocating motion of the piston is translated into rotational motion of the crankshaft which in turn creates pressure pulsations to drive gas flow. A barrier or restriction element 90 may substantially separate or isolate first cylinder 34 from other cylinders in the engine to increase the driving force generated by movement of piston 38. For example, restriction element 90 may comprise a rigid wall which partially separates second cylinder 39 from first cylinder 34. Restriction element 90 may include a passage 93 to permit a restricted fluid communication between first cylinder 34 and second cylinder 39 so that ventilation gases are permitted to flow through second cylinder 39 while being driven by pressure pulsation generated by first cylinder 34. In some examples, crankcase cylinder-to-cylinder communication may be decreased in response to crankcase pressure pulse amplitude falling below a threshold value.

FIG. 3 shows an example method 300 for an engine with a crankcase ventilation system, such as the example engines shown in FIGS. 1 and 2. In method 300, ventilation gases are driven by pressure pulsations within the crankcase rather than via steady state pressure differences in an engine intake.

At 302, method 300 includes determining if the engine is running so that cylinder piston movement may generate pressure fluctuations in the crankcase to drive ventilation gases through the crankcase ventilation system. If entry conditions are met at 302, method 300 proceeds to 304.

At 304, method 300 includes driving flow of crankcase ventilation gases through the crankcase from a fresh air inlet of the crankcase to an outlet of the crankcase via crankcase pressure pulsations. In some examples, the engine may be a boosted engine which includes a turbocharger and the inlet and outlet may be coupled upstream of a compressor coupled to the intake of the engine. For example, movement of piston 38 during engine operation may cause pressure pulsations in crankcase 28 adjacent to outlet 72 whereas pressure pulsations adjacent to inlet 71 may be at least partially muted since inlet 71 is coupled to a pulsation-restricted zone of the crankcase as described above. The difference in pressures between inlet 71 and outlet 72 may drive movement of ventilation gases in the crankcase ventilation system through the crankcase.

At 306, method 300 includes restricting backflow of crankcase ventilation gases from the outlet of the crankcase to the fresh air inlet of the crankcase. For example, movement of ventilation gases through the crankcase as driven by the pressure pulsations in the crankcase may be restricted via unidirectional check valve 85 which may be coupled either to the outlet 72 or to the inlet 71 so that backflow of ventilation gases in a direction from the outlet 72 to the inlet 71 is restricted. In this way, ventilation gases may flow in only one direction through crankcase ventilation system 16, namely ventilation gases only flow in a direction from breather tube 74 to conduit 76 due to the presence of unidirectional valve 85 in the crankcase ventilation system.

At 308, method 300 includes separating oil from the ventilation gases at the outlet of the crankcase and not separating oil from the ventilation gases at the inlet. As described above, since ventilation gases flow through the ventilation system in only one direction, from the inlet 71 to the outlet 72, only one oil separator 80 is needed at the outlet 72 to filter oil from the ventilation gases which are returned to intake 12.

As described above, in some examples, crankcase cylinder-to-cylinder communication may be at least partially restricted in the crankcase in order to increase a magnitude of pressure pulsations generated in the crankcase to increase an amount of flow of ventilation gases through the crankcase ventilation system. Thus, at 310, method 300 may optionally include restricting cylinder-to-cylinder communication. For example, cylinder-to-cylinder communication may be at least partially restricted when a crankcase pressure pulsation magnitude falls below a threshold via a barrier or restriction element such as element 90 shown in FIG. 2. In some examples, a cylinder-to-cylinder communication restriction element may be adjusted in response to engine operating conditions. For example, when a crankcase pressure pulsation magnitude falls below a threshold an opening of a restriction element in between cylinders may be reduced. As another example, in response to an engine speed above a threshold value an opening of a restriction element between cylinders may be increases to reduce a magnitude of pressure pulsations in the crankcase.

At 312, method 300 includes determining if a pressure is greater than a threshold. For example, method 300 may include monitoring pressures in the crankcase ventilation system, e.g., via a crankcase pressure sensor 63 and/or via a pressure sensor 81 disposed in oil separator 80. If a pressure in the ventilation system increases above a threshold value, an increased flow through the oil separator may be indicated. Increased flow through the oil separator may lead to degradation in operation of the oil separator as described above. If the pressure is not greater than the threshold at 312, method 300 proceeds to 314 to not limit an amount of crankcase ventilation flow through an oil separator in the outlet. However, if the pressure is greater than the threshold at 312, method 300 proceeds to 316.

At 316, method 300 includes limiting an amount of crankcase ventilation gas flow through an oil separator in the outlet. For example, pressure limiter/regulator 82 coupled to oil separator 80 and oil drain line 83 may be used to limit an amount of gas flow through oil separator 80 so that performance of oil separator 80 is not degraded.

Note that the example control and estimation routines included herein can be used with various system configurations. The specific routines described herein may represent one or more of any number of processing strategies such as event-driven, interrupt-driven, multi-tasking, multi-threading, and the like. As such, various actions, operations, or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, functions, or operations may be repeatedly performed depending on the particular strategy being used. Further, the described operations, functions, and/or acts may graphically represent code to be programmed into computer readable storage medium in the control system.

Further still, it should be understood that the systems and methods described herein are exemplary in nature, and that these specific embodiments or examples are not to be considered in a limiting sense, because numerous variations are contemplated. Accordingly, the present disclosure includes all novel and non-obvious combinations of the various systems and methods disclosed herein, as well as any and all equivalents thereof.

The invention claimed is:

1. A method, comprising:

driving crankcase ventilation gas flow through an engine crankcase from a crankcase fresh air inlet to a crankcase fresh air outlet and then to an engine intake upstream of a turbocharger compressor via crankcase pressure pulsations, while restricting crankcase ventilation gas backflow from the outlet to the inlet via a unidirectional check valve, the inlet coupled to the engine intake upstream of the turbocharger compressor, the compressor arranged upstream of a throttle, the inlet further coupled to a pulsation-restricted zone of the crankcase, and the outlet coupled to the engine intake via only a single conduit, and the single conduit couples the outlet to the engine intake upstream of the turbocharger compressor, the outlet further coupled to a pulsation zone of the crankcase, and the unidirectional check valve disposed in the outlet upstream of the single conduit.

2. The method of claim 1, further comprising separating oil from the ventilation gases at the outlet and not separating oil from the ventilation gases at the inlet.

3. The method of claim 1, further comprising, in response to a pressure above a threshold, limiting an amount of crankcase ventilation gas flow through an oil separator disposed in the outlet downstream of the unidirectional check valve.

4. The method of claim 1, wherein a pressure difference between the pulsation-restricted zone and the pulsation zone drives the crankcase ventilation gas flow through the crankcase from the inlet to the outlet.

5. The method of claim 1, wherein the pulsation-restricted zone is a region of the crankcase between a cylinder valve cover and combustion chamber walls of an engine cylinder, and wherein the pulsation zone is a region of the crankcase between an oil well and a crank.

6. The method of claim 1, further comprising restricting communication between first and second engine cylinders via a restriction element partially separating the first and second cylinders in the crankcase, wherein ventilation gases flow through the second cylinder while being driven by pressure pulsations generated by the first cylinder.

7. An engine crankcase ventilation system comprising:

a crankcase fresh air inlet coupled to an engine air intake upstream of an engine throttle and to a pulsation-restricted zone of a crankcase;

a crankcase outlet coupled to the air intake via only a single conduit, and the single conduit couples the outlet to the air intake upstream of the throttle, the outlet further coupled to a pulsation zone of the crankcase;

a restriction element partially separating first and second engine cylinders in the crankcase and having an opening; and a unidirectional check valve disposed in the outlet upstream of the single conduit, wherein the system is configured to drive crankcase ventilation gases from the inlet to the outlet and then to the air intake upstream of the throttle via pressure pulsations within the crankcase.

8. The system of claim 7, further comprising only a single oil separator coupled to the outlet downstream of the unidirectional check valve, the oil separator coupled to an oil drain line having a pressure regulator disposed therein, the oil drain line further coupled to the crankcase, where there are no other oil separators in the system.

9. The system of claim 8, wherein the pressure regulator is an oil liquid column pressure regulator.

10. The system of claim 7, wherein the engine includes a turbocharger and the inlet and outlet are coupled to the air intake upstream of a compressor of the turbocharger.

11. The system of claim 7, wherein the unidirectional check valve directs the flow of crankcase ventilation gases driven by crankcase pressure pulsations through the crankcase from the inlet to the outlet and restricts backflow of crankcase ventilation gases from the outlet to the inlet.

12. The system of claim 7, wherein communication between the first and second cylinders of the engine is at least partially restricted in the crankcase by the restriction element.

13. The system of claim 7, wherein the restriction element is configured to increase a driving force generated by movement of a piston of the first cylinder and wherein the opening in the restriction element is configured to permit a restricted fluid communication between the first and second cylinders.

14. A crankcase ventilation system for an engine with a crankcase comprising:

a crankcase fresh air inlet at a pulsation-restricted region of the crankcase at least partially isolated from a crank of the crankcase and coupled to an air intake of the engine upstream of a throttle of the engine;

a crankcase outlet at a pulsation region of the crankcase adjacent to the crank and coupled to the air intake via only a single conduit, and the single conduit couples the outlet to the air intake upstream of the throttle of the engine;

a rigid wall partially separating first and second cylinders of the engine in the crankcase and having an opening; and a unidirectional check valve disposed in the outlet upstream of the single conduit, wherein the system is configured to drive crankcase ventilation gases from the inlet to the outlet and then to the air intake upstream of the throttle via pressure pulsations within the crankcase.

15. The system of claim 14, further comprising only a single oil separator coupled to the outlet downstream of the unidirectional check valve and no oil separator coupled to the inlet, and an oil drain line coupled to the oil separator and the crankcase.

16. The system of claim 15, further comprising a pressure regulator coupled to the single oil separator and oil drain line.

17. The system of claim 14, wherein the unidirectional check valve directs flow of crankcase ventilation gases driven by crankcase pressure pulsations through the crankcase from the inlet to the outlet and restricts backflow of crankcase ventilation gases from the outlet to the inlet.

18. The system of claim 14, wherein communication between the first and second cylinders of the engine is at least partially restricted in the crankcase by the rigid wall.

19. The system of claim 14, wherein the rigid wall is configured to increase a driving force generated by movement of a piston of the first cylinder and wherein the opening in the rigid wall is configured to permit a restricted fluid communication between the first and second cylinders.

* * * * *